US007958949B2

(12) United States Patent
Al Hadhrami

(10) Patent No.: US 7,958,949 B2
(45) Date of Patent: Jun. 14, 2011

(54) METHOD AND APPARATUS FOR THREE DIMENSIONAL GEOSTEERING

(75) Inventor: Mohsin Hamed Al Hadhrami, Muscat (OM)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 12/129,188

(22) Filed: May 29, 2008

(65) Prior Publication Data

US 2008/0296064 A1 Dec. 4, 2008

Related U.S. Application Data

(60) Provisional application No. 60/941,131, filed on May 31, 2007.

(51) Int. Cl.
*E21B 47/18* (2006.01)
*G01V 3/00* (2006.01)

(52) U.S. Cl. ..... 175/40; 175/45; 324/346; 324/348; 340/854.6; 702/9

(58) Field of Classification Search ..... 175/61, 175/45, 50; 702/9; 324/346, 348; 340/854.6
See application file for complete search history.

(56) References Cited

U.S. PATENT DOCUMENTS

| | | | | |
|---|---|---|---|---|
| 4,601,353 | A | 7/1986 | Schuh et al. | |
| 5,230,386 | A * | 7/1993 | Wu et al. | 175/45 |
| 5,241,273 | A | 8/1993 | Luling | |
| 5,495,174 | A * | 2/1996 | Rao et al. | 324/339 |
| RE35,386 | E | 12/1996 | Wu et al. | |
| 5,678,643 | A | 10/1997 | Robbins et al. | |
| 6,581,010 | B2 * | 6/2003 | Dubinsky et al. | 702/9 |
| 6,594,584 | B1 * | 7/2003 | Omeragic et al. | 702/9 |
| 6,719,069 | B2 * | 4/2004 | Alft et al. | 175/24 |
| 6,911,824 | B2 | 6/2005 | Bittar | |
| 6,942,044 | B2 | 9/2005 | Moore et al. | |
| 6,969,994 | B2 | 11/2005 | Minerbo et al. | |
| 7,167,006 | B2 | 1/2007 | Itskovich | |
| 7,200,492 | B2 | 4/2007 | Hassan et al. | |

FOREIGN PATENT DOCUMENTS

GB 2426845 A 12/2006

* cited by examiner

*Primary Examiner* — Daniel P Stephenson
*Assistant Examiner* — Yong-Suk Ro
(74) *Attorney, Agent, or Firm* — Yee & Associates, P.C.

(57) ABSTRACT

A technique for drilling a borehole includes obtaining data from a tool in the borehole for a plurality of positions in the borehole that is being drilled to form acquired data indicative of directional electromagnetic propagation measurements. The technique includes identifying a plurality of distances to a boundary between formations in ground from the plurality of positions in the borehole based on the measurements; identifying a trajectory of the borehole using the plurality of distances; and deciding whether to change the trajectory of the borehole using a change in the plurality of distances between the trajectory and the boundary. The trajectory of the borehole may be changed in both inclination and azimuth.

16 Claims, 5 Drawing Sheets

METHOD AND APPARATUS FOR THREE DIMENSIONAL GEOSTEERING

This application claims priority based on U.S. Provisional Patent Application Ser. No. 60/941,131, filed on May 31, 2007.

BACKGROUND OF THE INVENTION

1. Field of the Invention

This invention relates generally to drilling boreholes and in particular to a method and apparatus for geosteering the drilling of boreholes in three dimensions. Still more particularly, the present invention relates to a computer implemented method, apparatus, and computer usable program code for real-time geosteering in three dimensions.

2. Background of the Invention

As the demand for energy grows, pressure mounts on companies to extract as much hydrocarbon as possible from reservoirs. In other words, the oil industry is under pressure to improve recovery factors. One key element that is fundamental in achieving higher recovery factors from reservoirs is to improve the net-to-gross ratio of horizontal wells. Currently, improving this ratio can only be accomplished by increasing the success rate in making reservoir contact while drilling wells.

Traditionally, the steering of horizontal wells has been based on logging-while-drilling measurements (LWDs). These types of measurements rely on sensors to measure the characteristics of the different formations when drilling through those formations. This information is used to make the correct steering decision. The steering of wells based on real-time formation evaluation data is referred to as geosteering. This type of geosteering is currently a reactive process. As a result, if the measurements indicate that an undesired formation has been reached, the borehole has already entered that formation. For example, in drilling a borehole, it is desirable to drill through sand as opposed to shale. Using logging-while-drilling measurements may result in the borehole exiting the sand and entering a shale formation.

Therefore, it would be advantageous to have an improved method, apparatus, and computer usable program code for geosteering in drilling boreholes. In particular, it would be advantageous to have a method and apparatus that allows decisions to be made to avoid undesired formations before those formations have been reached in drilling the borehole for a well.

SUMMARY OF THE INVENTION

In view of the above problems, an object of the present invention is to provide methods, apparatuses and systems for geosteering the drilling of boreholes in three dimensions while eliminating or minimizing the impact of the problems and limitations described.

The illustrative embodiments of the present invention provide a method, apparatus, and computer usable program code for drilling a borehole. Data is obtained from a tool in the borehole for a plurality of positions in the borehole that is being drilled to form acquired data. A plurality of distances to a boundary between formations in ground are identified from the plurality of positions in the borehole using the acquired data. A trajectory of the borehole is identified using the plurality of distances, and a decision is made as to whether to change the trajectory of the borehole using a change in the distance between the trajectory and the boundary. The trajectory of the borehole may be changed in both inclination and azimuth.

The trajectory of the borehole may be changed to maintain the borehole within a desired formation in the ground in response to a decision to change the trajectory of the borehole. In determining whether to change the trajectory and the borehole, an angle may be identified between the trajectory and the boundary. Then, a determination may be made as to whether the angle is less than a threshold angle, wherein the threshold angle is used to determine when a change in trajectory is required to maintain the borehole within a formation. Additionally, in the illustrative embodiments, a position of the borehole may be displayed relative to the boundary for the plurality of positions on a display device. The tool may be a logging tool that provides directional electromagnetic propagation measurements. The desired formation in these illustrative examples may be a sand region in the ground.

Other objects, features, and advantages of the present invention will become apparent to those of skill in the art by reference to the figures, the description that follows, and the claims.

DETAILED DESCRIPTION OF THE DRAWINGS

Figure 1:
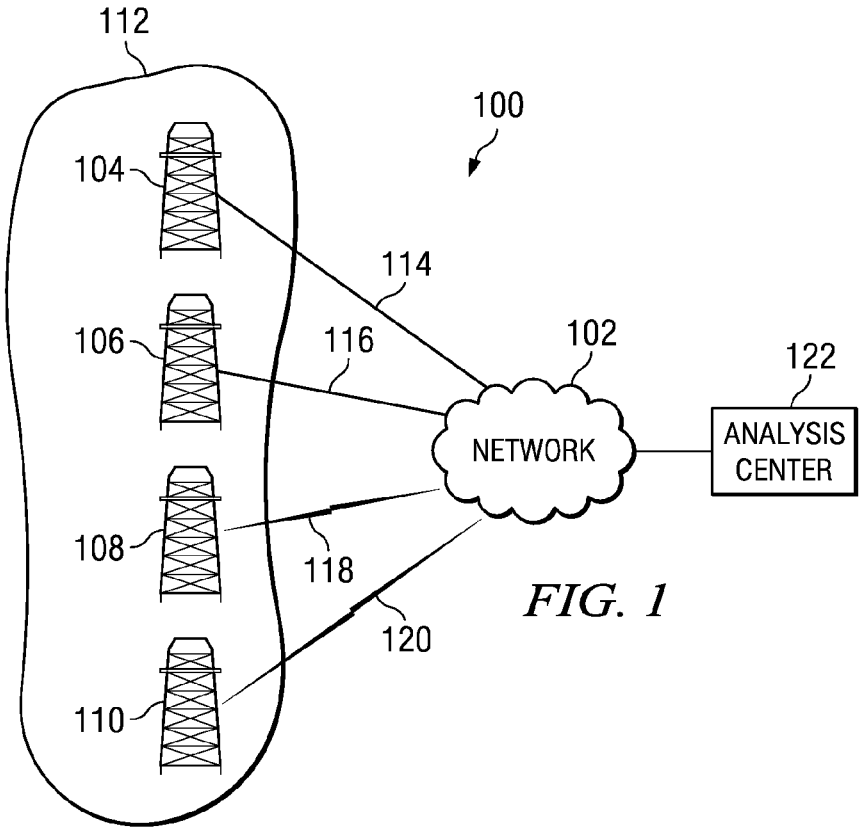
FIG. 1 is a pictorial representation of a network data processing system in which a preferred embodiment of the present invention may be implemented.

In the following detailed description of the preferred embodiments and other embodiments of the invention, reference is made to the accompanying drawings. It is to be understood that those of skill in the art will readily see other embodiments and changes may be made without departing from the scope of the invention. With reference now to FIG. 1, a pictorial representation of a network data processing system is depicted in which a preferred embodiment of the present invention may be implemented. In this example, network data processing system 100 is a network of computing devices in which different embodiments of the present invention may be implemented. Network data processing system 100 includes network 102, which is a medium used to provide communications links between various devices and computers in communication with each other within network data processing system 100. Network 102 may include connections, such as wire, wireless communications links, or fiber optic cables.

The data could even be delivered by hand with the data being stored on a storage device, such as a hard disk drive, DVD, or flash memory.

In this depicted example, well sites 104, 106, 108, and 110 have computers or other computing devices that produce data regarding wells located at these well sites. In these examples, well sites 104, 106, 108, and 110 are located in geographic region 112. This geographic region is a single reservoir in these examples. Of course, these well sites may be distributed across diverse geographic regions and/or over multiple reservoirs, depending on the particular implementation. Well sites 104 and 106 have wired communications links 114 and 116 to network 102. Well sites 108 and 110 have wireless communications links 118 and 120 to network 102.

Analysis center 122 is a location at which data processing systems, such as servers, are located to process data collected from well sites 104, 106, 108, and 110. Of course, depending on the particular implementation, multiple analysis centers may be present. These analysis centers may be, for example, at an office or on-site in geographic region 112 depending on the particular implementation. In these illustrative embodiments, analysis center 122 analyzes data from well sites 104, 106, 108, and 110 using processes for different embodiments of the present invention.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational, and other computer systems that route data and messages. Of course, network data processing system 100 also may be implemented as a number of different types of networks, such as for example, an intranet, a local area network (LAN), or a wide area network (WAN). FIG. 1 is intended as an example and not as an architectural limitation for different embodiments.

Figure 2:
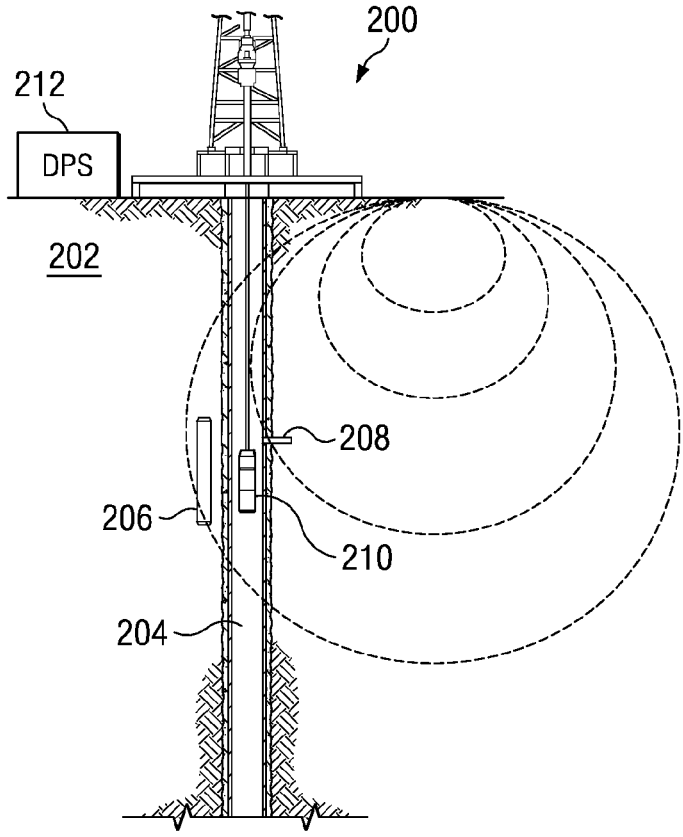
FIG. 2 is a diagram illustrating a well site from which data is obtained in accordance with a preferred embodiment of the present invention.

Turning now to FIG. 2, a diagram illustrating a well site from which data is obtained is depicted in accordance with a preferred embodiment of the present invention. Well site 200 is an example of a well site, such as well site 104 in FIG. 1. The data obtained from well site 200 is referred to as multidimensional data in these examples.

In this example, well site 200 is located on formation 202. During the creation of borehole 204 in formation 202, different samples are obtained. For example, core sample 206 may be obtained as well as sidewall plug 208. Further, logging tool 210 may be used to obtain other information, such as pressure measurements and factor information. Further, from creating borehole 204, drill cuttings and mud logs are obtained. In these depicted examples, logging tool 210 is a logging-while-drilling tool that provides directional electromagnetic measurements. In these examples, these directional electromagnetic measurements are obtained through the use of tilted and transverse current-loop antennas found within logging tool 210. The directional electromagnetic components within logging tool 210 are designed to optimize sensitivity to various desired formation parameters in these depicted examples.

In these examples, logging tool 210 may include a symmetrical transmitter-receiver configuration that optimizes sensitivity to desired formation parameters. This tool also may cancel the influence of an isotropy and formation dip, while adding symmetrical directional measurements to maximize sensitivity to boundaries. This type of information may be used for geosteering decisions. An example of a logging tool that may be used as logging tool 210 is Periscope 15, which is a tool available from Schlumberger. These types of tools may make directional electromagnetic propagation measurements at multiple spacing and multiple frequencies. The type of tool used and the measurements may take any form that allows for an identification of the distance from borehole 204 to a boundary between regions or formation in the ground and the direction to the boundary from borehole 204. One example of a type of measurement is resistivity.

With these measurements, decisions regarding drilling in well sites, such as well site 200, may be made. These decisions may be to maintain borehole 204 within desired formations or regions in the ground while avoiding undesirable regions. For example, borehole 204 may be drilled within a sand region, while avoiding shale regions in the ground. Although these examples use a particular type of measurement, any type of data that can provide data to identify distances from a borehole to boundaries between formations and the orientation of those boundaries relative to the borehole may be used.

This information may be collected by data processing system (dps) 212 and transmitted to an analysis center, such as analysis center 122 in FIG. 1 for analysis. Geosteering decisions may be made at analysis center 122 based on the data collected. Alternatively, the analysis in geosteering decisions may be made through data processing system 212 at well site 200. These decisions may be made using a geosteering program or process or by users analyzing the data collected by data processing system 212.

Figure 3:
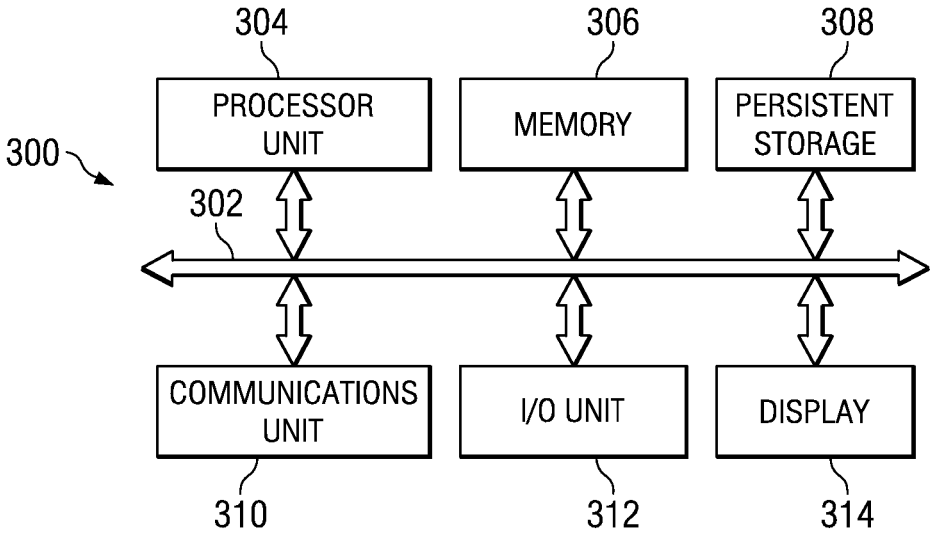
FIG. 3 depicts a diagram of a data processing system in accordance with a preferred embodiment of the present invention.

Turning now to FIG. 3, a diagram of a data processing system is depicted in accordance with an illustrative embodiment of the present invention. In this illustrative example, data processing system 300 includes communications fabric 302, which provides communications between processor unit 304, memory 306, persistent storage 308, communications unit 310, input/output (I/O) unit 312, and display 314.

Processor unit 304 serves to execute instructions for software that may be loaded into memory 306. Processor unit 304 may be a set of one or more processors or may be a multiprocessor core, depending on the particular implementation. Further, processor unit 304 may be implemented using one or more heterogeneous processor systems in which a main processor is present with secondary processors on a single chip. Memory 306, in these examples, may be, for example, a random access memory. Persistent storage 308 may take various forms depending on the particular implementation. For example, persistent storage 308 may be, for example, a hard drive, a flash memory, a rewritable optical disk, a rewritable magnetic tape, or some combination of the above.

Communications unit 310, in these examples, provides for communications with other data processing systems or devices. In these examples, communications unit 310 may be a network interface card. I/O unit 312 allows for input and output of data with other devices that may be connected to data processing system 300. For example, I/O unit 312 may provide a connection for user input though a keyboard and mouse. Further, I/O unit 312 may send output to a printer. Display 314 provides a mechanism to display information to a user. In these examples, I/O unit 312 may be connected to a tool, such as logging tool 210 in FIG. 2. In this manner, data processing system 300 may receive data gathered by a logging tool in a well bore.

Instructions for the operating system and applications or programs are located on persistent storage 308. These instructions may be loaded into memory 306 for execution by processor unit 304. The processes of the different embodiments may be performed by processor unit 304 using computer implemented instructions, which may be located in a memory, such as memory 306.

The different illustrative embodiments of the present invention recognize that proactive steering approach in drilling boreholes may be accomplished by using data, such as directional electromagnetic measurements, that can identify approaching boundaries. The different illustrative embodiments of the present invention also recognize another element for a proactive steering approach in geosteering, an ability to change the trajectory of the borehole in both inclination and azimuth. This type steering in drilling boreholes is especially useful when dealing with a channel sand environment in which the shape of the sand regions or bodies within the ground are not well delineated by seismic data.

The illustrative embodiments of the present invention provide a method, apparatus, and computer usable program code for drilling a borehole. Data is obtained from a tool in the borehole for a plurality of positions in the borehole that is being drilled to form acquired data. Distances to a boundary between formations in ground from the plurality of positions in the borehole are identified using the acquired data. A trajectory of the borehole is identified using the plurality of distances. A decision is made as to whether to change the trajectory of the borehole using a change in the distance between the trajectory and the boundary. The direction may be changed in both inclination and azimuth. This type of change provides for three-dimensional geosteering that is currently unused by presently available geosteering processes. The different illustrative embodiments of the present invention employ a multi disciplinary collaboration and integration of techniques to maximize the net-to-gross ratio obtained from drilling horizontal lateral wells in this type of environment.

Using the illustrative embodiments of the present invention, three-dimensional geosteering is performed in which drilling occurs through more sand regions than shale regions, especially in channel formations. The different illustrative embodiments recognize that steering in the vertical direction is not sufficient in many cases in the sand region during the drilling process. This inclination based or up-down direction is one of the dimensions taken into account by the different embodiments of the present invention. The different embodiments of the present invention also use azimuthal measurements to steer the drilling of the well in an azimuth sense as well. In other words, the well also may be drilled in a left-right direction in addition to an up-down direction using the different embodiments of the present invention. In these illustrative embodiments, boundary orientation is identified using a periscope azimuthal view. This orientation is compared to other measurements on logging while drilling. As a result, an option can be used to steer the drilling of the borehole for the well in an inclination (up and down) direction and in an azimuthal (left and right) direction. In other words, the different embodiments of the present invention allow for three-dimensional drilling in which inclination and azimuthal directions may be altered.

Figure 4:
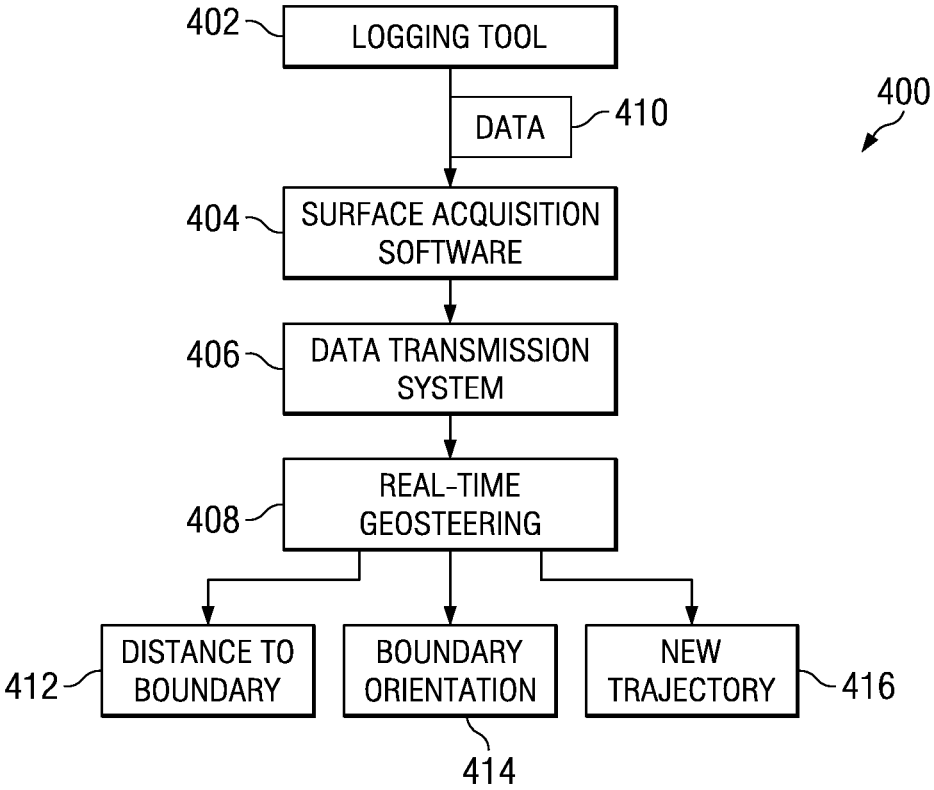
FIG. 4 is a diagram illustrating components used in proactive geosteering in accordance with a preferred embodiment of the present invention.

With reference now to FIG. 4, a diagram illustrating components used in proactive geosteering is depicted in accordance with an illustrative embodiment of the present invention. In this example, the different components include both software and hardware components to provide information for geosteering. Geosteering system 400, in this example, includes logging tool 402, surface acquisition software 404, data transmission system 406, and real-time geosteering 408. In this particular example, logging tool 402 may be a logging tool, such as Periscope 15, which is available from Schlumberger. Surface acquisition software 404 receives data 410 from logging tool 402. In these examples, surface acquisition software 404 is found in a data processing system, such as data processing system 212 in FIG. 2 at a well site. Data transmission system 406 transmits the data to real-time geosteering 408. Real-time geosteering 408 is software that is located in an analysis center, such as analysis center 122 in FIG. 1.

Depending on the particular implementation, real-time geosteering 408 also may be located on the same data processing system as surface acquisition software 404. In that case, data transmission system 406 is unnecessary to send the data to another location. In these particular examples, real-time geosteering 408 processes data 410 to generate an analysis that includes distance to boundary 412 and boundary orientation 414. Based on this information, changes to the inclination and azimuth may be made to stay within a particular formation. These decisions as to changes in the direction of the well may be made by an operator presented with distance to boundary 412 and boundary orientation 414. Alternatively, real-time geosteering 408 may include processes to calculate new trajectory 416. New trajectory 416 is designed to avoid exiting a particular formation of interest.

Figure 5:
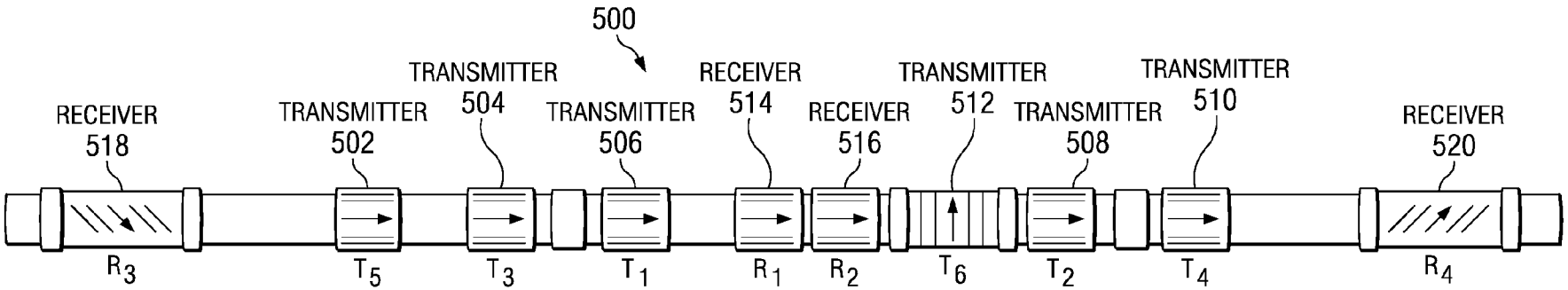
FIG. 5 is a schematic diagram of a logging tool for detecting bed boundaries according to an illustrative embodiment.

Referring now to FIG. 5, a schematic diagram of a logging tool for detecting bed boundaries is shown according to an illustrative embodiment. Logging tool 500 is a deep-reading directional propagation-resistivity device capable of detecting bed boundaries, such as logging tool 402 of FIG. 4. Logging tool 500 may be a commercially available logging tool, such as PeriScope 15, available from Schlumberger, Ltd.

Logging tool 500 comprises a symmetrical sensor array of transmitters 502, 504, 506, 508, 510, and 512 and of receivers 514, 516, 518, and 520. Transmitters 502, 504, 506, 508 and 510 are arranged axially along logging tool 500. Transmitter 512 is positioned transversely along logging tool 500. Receivers 514 and 516 are positioned in the center of logging tool 500 and arranged axially. Receivers 518 and 520 are positioned at each end of logging tool 500 with the receivers tilted 45° to the axis of logging tool 500.

The axially positioned transmitters 502, 504, 506, 508, 510 and receivers 514, 516 provide conventional propagation-resistivity measurements at spacings of 96, 84, 34 and 22 inches, and at frequencies of 100 kHz, 400 kHz and 2 MHz. The nonaxial transmitter 512 and receivers 518, 520 provide directional (azimuthal) measurements at an effective spacing of 59 inches, at frequencies of 100 kHz and 400 kHz. Changes in phase-shift and attenuation-resistivity polarity are used to indicate the position of a bed boundary relative to logging tool 500. The directional measurements, provided by the nonaxial transmitter 512 and receivers 518, 520, are sensitive to, and can be used for, characterizing resistivity anisotropy, and they permit shoulder-bed correction of measured formation resistivity.

Figure 6:
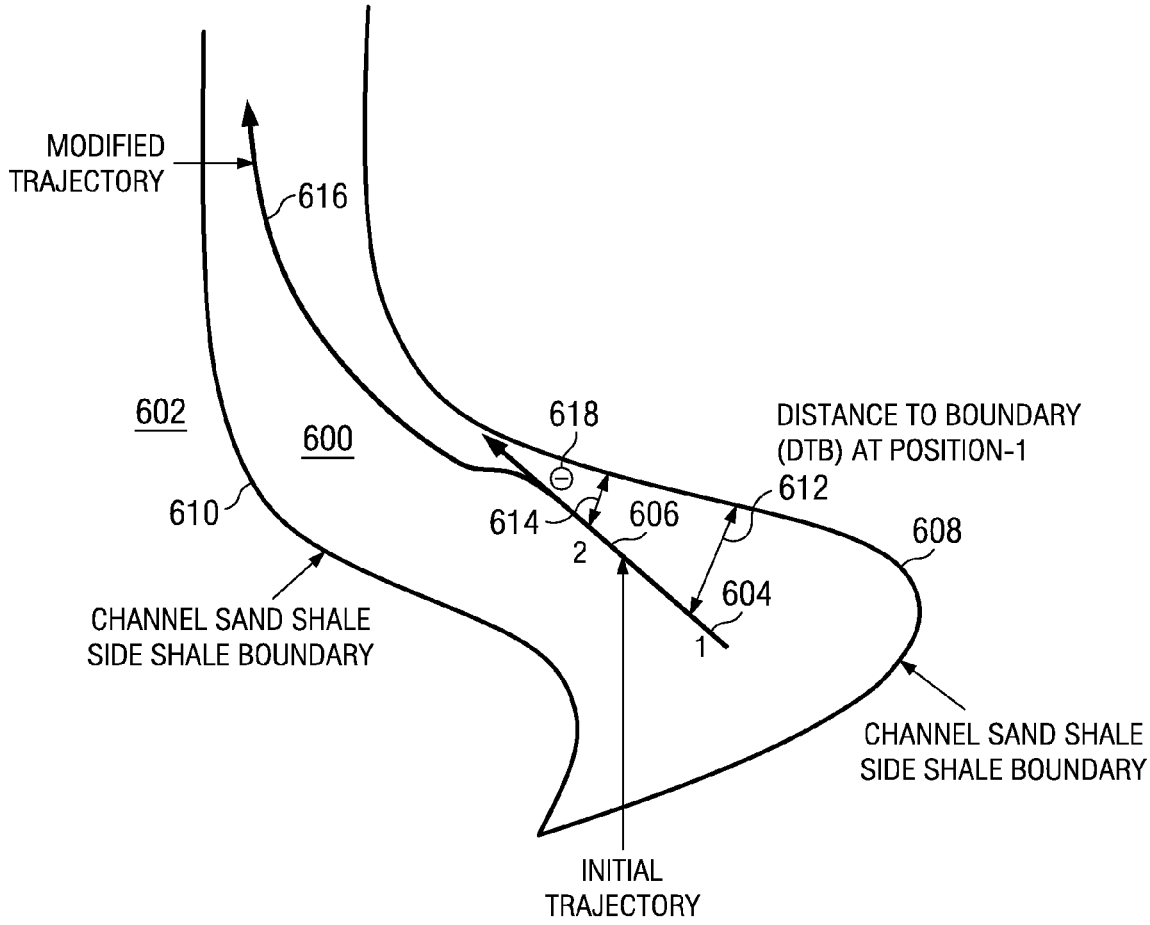
FIG. 6 is a diagram illustrating the creation of a well bore using geosteering in accordance with a preferred embodiment of the present invention.

Turning now to FIG. 6, a diagram illustrating the creation of a borehole using geosteering is depicted in accordance with an illustrative embodiment of the present invention. In this example, a borehole is being drilled within an area that contains sand region 600 and shale region 602. Borehole 604 has initial trajectory 606 in the well. In this example, borehole 604 is between boundary 608 and boundary 610. As can be seen, as borehole 604 progresses from point 612 to point 614, the distance to boundary 608 between sand region 600 and shale region 602 decreases. These distances to boundary 608 may be identified through the use of a logging tool, such as logging tool 402 in FIG. 4.

Modifications to the trajectory of borehole 604 may be made before borehole 604 reaches boundary 608 using the geosteering process in the different illustrative embodiments of the present invention. The modifications to the trajectory result in modified trajectory 616, which causes borehole 604 to stay within sand region 600 between boundary 608 and boundary 610. The data received and used to perform this geosteering is used to provide changes in well trajectories in both inclination and azimuth.

In these examples, trajectory 606 may be determined from data received from the logging tool at points 612 and 614. This data, in these examples, includes symmetrical directional measurements. The symmetrical directional measurements are used to identify distance to a boundary in these examples. In these examples, when the angle for points 612 and 614 are close to the same angle or the same angle, this data indicates that the boundary is a particular direction or angle relative to the borehole. With this information, an angle such as angle θ 618 may be identified. Depending on the particular implementation, a threshold angle may be selected to indicate when a change in trajectory is required. The size of the angle may depend on the amount of distance needed to change the direction of a borehole to avoid crossing a boundary. If the identified angle θ 618 is less than the threshold angle, then a condition is considered to be present in which a change in the direction or trajectory of borehole 604 should be altered to avoid crossing boundary 608 or boundary 610.

Figure 7:
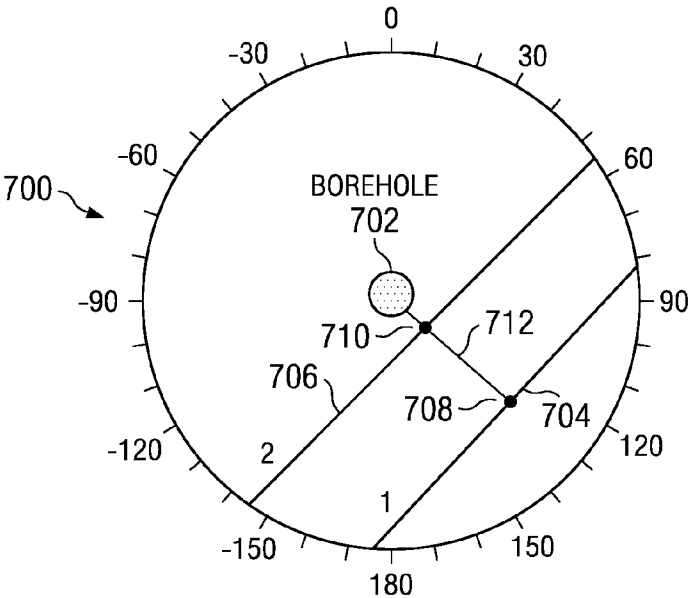
FIG. 7 is a diagram illustrating an azimuthal view in accordance with a preferred embodiment of the present invention.

Turning now to FIG. 7, a diagram illustrating an azimuthal view is depicted in accordance with an illustrative embodiment of the present invention. In this example, display 700 is a display of an azimuthal view of a borehole with respect to a boundary, such as boundary 610 in FIG. 6. Display 700 is an example of a display that may be presented by a data processing system, such as data processing system 300 in FIG. 3. In display 700, borehole 702 is shown with respect to boundary 704. The distance between borehole 702 and boundary 704 is shown with respect to point 612 in FIG. 6. Boundary 706 is displayed when another measurement is taken at point 614 in FIG. 6.

In these examples, boundary 704 and boundary 706 are presented as planes within display 700. These planes are identified through the measurements made by the logging tool within the borehole. In these examples, the measurements are points 708 and 710. These measurements represent the strongest or greatest measurement obtained from the logging tool. Points 708 and 710 each have a distance from borehole 702 and also provide an angle from which the measurement was made relative to borehole 702. In these examples, each point has an angle of 130 degrees. Boundary 706 and 704 may be identified by drawing a line from borehole 702 to each point. In this example, line 712 includes point 708 and 710. Boundaries 704 and 706 are then obtained by drawing lines that are perpendicular or orthogonal to line 712 at points 708 and 710, respectively.

As can be seen, borehole 702 is closer to boundary 706 than boundary 704 as the borehole progresses through the formation. With this information, the trajectory of borehole 702 may be identified using the distances and the angles for the distances relative to the borehole. In other words, each of these points has a distance and angle relative to the borehole. This information is used to identify the trajectory. As a result, this information may be used to make a trajectory change with respect to an azimuthal view. In other words, the borehole can be steered to the left with respect to boundary 706 to avoid crossing the boundary into a shale formation in this example.

Figure 8:
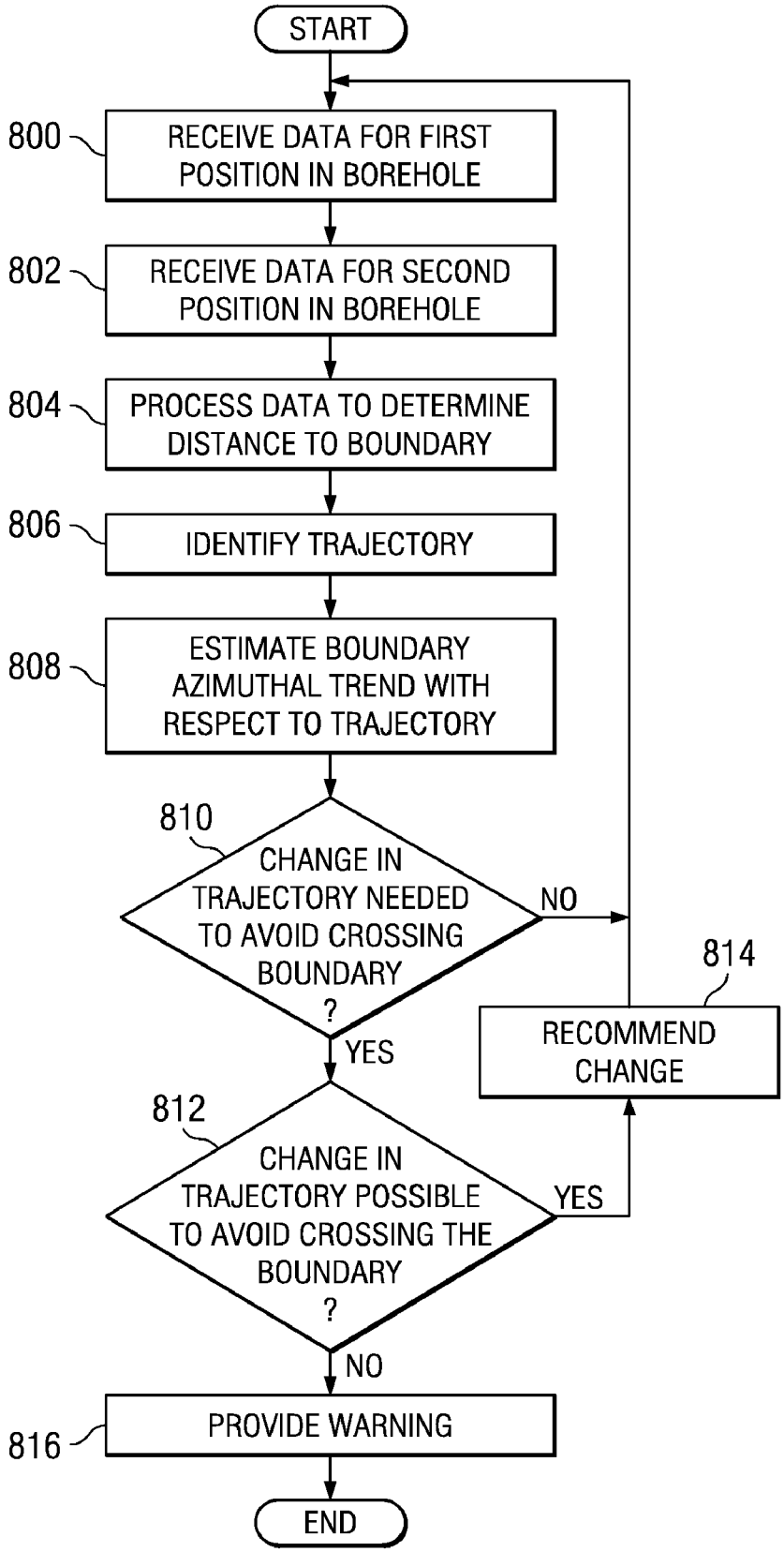
FIG. 8 is a high-level flowchart illustrating a process for providing geosteering decisions in accordance with a preferred of the present invention.

With reference next to FIG. 8, a high-level flowchart illustrating a process for providing geosteering decisions is depicted in accordance with an illustrative embodiment of the present invention. The process illustrated in FIG. 8 may be implemented in a software component, such as real-time geosteering 408 in FIG. 4. Of course, this process may be implemented in other components in other locations depending on the particular implementation.

The process begins with receiving data for a first position in a borehole (step 800). Thereafter, data is received for a second position in the borehole (step 802). In these examples, the data received includes an angle at which the highest resistively measurement is identified from the logging tool. This information is used to identify a distance from the tool to the boundary. Thereafter, the data is processed to determine the distance to the boundary from the two positions in which data was received (step 804). Next, this information is used to identify a trajectory for the borehole (step 806). This trajectory may be identified through trigonomic calculations used to determine an angle present between the trajectory and the boundary based on the direction of the trajectory.

Then, a boundary azimuthal trend is estimated with respect to the trajectory (step 808). This trend may be determined based on the angle. If the angle is less than some selected threshold, the trend may be that the trajectory of the borehole will intersect or cross the boundary. Next, a determination is made as to whether a change in trajectory for the borehole is needed to avoid crossing the boundary (step 810). If a change is needed, a determination is then made as to whether a change in the trajectory in the drilling of the boreholes is possible to avoid crossing the boundary (step 812).

In some cases, a limitation may be present as to how much change in the trajectory can be made for a borehole that is being drilled. If the change that can be made in the trajectory is not large enough, then the boundary cannot be avoided. If a change in trajectory is possible to avoid crossing the boundary, then a recommended change is generated (step 814). This change may be merely an indication that a change in the borehole direction should be made. Alternatively, depending on the particular implementation, actual estimates as to changes in the direction may be provided in step 814. Thereafter, the process returns to step 800 to obtain additional position information from the borehole for analysis.

With reference again to step 812, if a change in trajectory is not possible to avoid crossing the boundary, then a warning is provided (step 816) with the processing terminating thereafter. With reference again to step 810, if a change in trajectory is not needed to avoid crossing the boundary, the process returns to step 800 to obtain data for two more points to process. The illustrative embodiments show the use of two points along the borehole to determine a trajectory. This example is not meant to limit the present invention to just using two points for identifying a trajectory. More than two points may be used depending on the implementation.

Thus, the different illustrative embodiments may be used in drilling a borehole. Data is obtained from a tool in the borehole for positions in the borehole being drilled to form acquired data. Distances to a boundary between formations in the ground are identified from these positions in the borehole using the acquired data. A trajectory of the borehole is identified using these distances. A decision as whether to change the trajectory of the borehole using the change in the distance between the trajectory and the boundary may be made. In this manner, the trajectory of the borehole may be changed in both inclination and azimuth.

In addition to using this information for managing the drilling of a borehole at a well site, the information obtained from drilling the well also may be used to map sand channels. Additionally, a sand channel trend also may be drawn or identified using data obtained from the borehole. In this manner, drawing the trend of channels of sand may be performed within channels, which currently cannot be done.

The flowcharts and block diagrams in the different depicted embodiments illustrate the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

Thus, the illustrative embodiments of the present invention provide a method, apparatus, and computer usable program code for drilling a borehole. Data is obtained from a tool in the borehole for a plurality of positions in the borehole that is being drilled to form acquired data. Distances to a boundary between formations in ground from the plurality of positions in the borehole are identified using the acquired data. A trajectory of the borehole is identified using the plurality of distances. A decision is made as to whether to change the trajectory of the borehole using a change in the distance between the trajectory and the boundary. The direction may be changed in both inclination and azimuth. This type of change provides for three-dimensional geosteering. With this type of geosteering, maintaining a borehole within a desired formation is made easier.

Although the foregoing is provided for purposes of illustrating, explaining, and describing certain embodiments of the invention in particular detail, modifications and adaptations to the described methods, systems, and other embodiments will be apparent to those skilled in the art and may be made without departing from the scope or spirit of the invention.

What is claimed is:

1. A method for drilling a borehole, the method comprising:

obtaining data from a tool in the borehole that is being drilled to form acquired data indicative of directional electromagnetic propagation measurements, each of the directional electromagnetic propagation measurements identifying a distance from a position in the borehole to a boundary between formations in ground and an angle associated with the distance;

determining a current trajectory of the borehole using the distances and angles identified by the directional electromagnetic propagation measurements; and deciding whether to change the current trajectory of the borehole based on the determined trajectory, wherein the current trajectory of the borehole may be changed in both inclination and azimuth.

2. The method of claim 1 further comprising:

responsive to a decision to change the current trajectory of the borehole, changing the current trajectory of the borehole to maintain the borehole within a desired formation in the ground.

3. The method of claim 2, wherein the desired formation is a sand region in the ground.

4. The method of claim 1, wherein the deciding comprises:

determining whether an angle between the current trajectory and the boundary is less than a threshold angle, wherein the threshold angle is used to determine when a change in the current trajectory of the borehole is required to maintain the borehole within a formation.

5. The method of claim 1 further comprising:

displaying a position of the borehole relative to the boundary on a display device.

6. The method of claim 1, wherein the deciding comprises:

determining whether at least two of the identified angles are substantially the same;

selectively assigning an angle of the current trajectory relative to the boundary based on the determination of whether said at least two identified angles are substantially the same; and basing the deciding on a comparison of said angle assigned to the current trajectory to a threshold angle.

7. A computer program product comprising:

a computer usable medium having computer usable program code for drilling a borehole, said computer program product comprising:

computer usable program code for obtaining data from a tool in the borehole that is being drilled to form acquired data indicative of directional electromagnetic propagation measurements, each of the directional electromagnetic propagation measurements identifying a distance from a position in the borehole to a boundary between formations in ground and an angle associated with the distance;

computer usable program code for determining a computer trajectory of the borehole using the distances and angles identified by the directional electromagnetic propagation measurements; and computer usable program code for deciding whether to change the current trajectory of the borehole based on the determined trajectory, wherein the current trajectory of the borehole may be changed in both inclination and azimuth.

8. The computer program product of claim 7 further comprising:

computer usable program code, responsive to a decision to change the current trajectory of the borehole, for changing the current trajectory of the borehole to maintain the borehole within a desired formation in the ground.

9. The computer program product of claim 8, wherein the desired formation is a sand region in the ground.

10. The computer program product of claim 7, wherein the computer usable program code for deciding whether to change the current trajectory of the borehole comprises:

computer usable program code for determining whether at least two of the identified angles are substantially the same;

computer usable program code for selectively assigning an angle of the current trajectory relative to the boundary based on the determination of whether said at least two identified angles are substantially the same; and computer usable program code for basing the deciding on a comparison of said angle assigned to the current trajectory to a threshold angle.

11. The computer program product of claim 7 further comprising:

computer usable program code for displaying a position of the borehole relative to the boundary on a display device.

12. A data processing system comprising:

a bus;

a communications unit connected to the bus;

a storage device connected to the bus, wherein the storage device includes computer usable program code; and a processor unit connected to the bus, wherein the processor unit executes the computer usable program code to obtain data from a tool in a borehole that is being drilled to form acquired data indicative of directional electromagnetic propagation measurements, each of the directional electromagnetic propagation measurements identifying a distance from a position in the borehole to a boundary between formations in ground and an angle associated with the distance;

determine a current trajectory of the borehole using the distances and angles identified by the directional electromagnetic propagation measurements; and decide whether to change the current trajectory of the borehole based on the determined trajectory, wherein the current trajectory of the borehole may be changed in both inclination and azimuth.

13. The data processing system of claim 12, wherein the processor unit further executes the computer usable program code to change the current trajectory of the borehole to maintain the borehole within a desired formation in the ground in response to a decision to change the current trajectory of the borehole.

14. The data processing system of claim 13, wherein the desired formation is a sand region in the ground.

15. The data processing system of claim 12, wherein the processor is adapted to:

determine whether at least two of the identified angles are substantially the same;

selectively assign an angle of the current trajectory relative to the boundary based on the determination of whether said at least two identified angles are substantially the same; and base the decision on a comparison of said angle assigned to the current trajectory to a threshold angle.

16. The data processing system of claim 12 wherein the processor unit further executes the computer usable program code to display a position of the borehole relative to the boundary on a display device.

* * * * *